US008316551B2

(12) United States Patent
Gorsuch et al.

(10) Patent No.: US 8,316,551 B2
(45) Date of Patent: Nov. 27, 2012

(54) AUTO-CORRECTING BOW SIGHT

(76) Inventors: Timothy M. Gorsuch, Mukwonago, WI (US); James A. Buckley, Whitefish Bay, WI (US)

( * ) Notice: Subject to any disclaimer, the term of this patent is extended or adjusted under 35 U.S.C. 154(b) by 253 days.

(21) Appl. No.: 12/615,071

(22) Filed: Nov. 9, 2009

(65) Prior Publication Data

US 2010/0115778 A1 May 13, 2010

Related U.S. Application Data

(60) Provisional application No. 61/112,835, filed on Nov. 10, 2008.

(51) Int. Cl.
*F41G 1/467* (2006.01)
*F41G 1/473* (2006.01)
*G01C 3/00* (2006.01)

(52) U.S. Cl. ..... 33/265; 124/87

(58) Field of Classification Search ..... 33/265; 42/111, 122; 124/87
See application file for complete search history.

(56) References Cited

U.S. PATENT DOCUMENTS 4,290,219 A 9/1981 Boller et al.
4,296,725 A 10/1981 Broderick
4,617,741 A 10/1986 Bordeaux et al.
4,753,528 A 6/1988 Hines et al.
4,894,921 A 1/1990 Barlow
5,442,861 A 8/1995 Lorocco
5,479,712 A 1/1996 Hargrove et al.
5,612,779 A 3/1997 Dunne
5,634,278 A * 6/1997 London ..... 42/132
5,652,651 A 7/1997 Dunne
5,926,260 A 7/1999 Dunne et al.
6,073,352 A 6/2000 Zykan et al.
6,154,971 A 12/2000 Perkins
6,191,574 B1 2/2001 Dilger
6,397,483 B1 6/2002 Perkins
6,445,444 B2 9/2002 Dunne
6,526,956 B1 3/2003 Hankins
6,952,881 B2 10/2005 McGivern
7,162,806 B1 1/2007 Swiggart
7,296,358 B1 11/2007 Murphy et al.
7,313,871 B2 1/2008 Lines et al.
7,513,050 B2 4/2009 Kroening, Jr.
7,614,156 B1 11/2009 Imig
8,065,807 B2 * 11/2011 Rucinski ..... 33/265
(Continued)

OTHER PUBLICATIONS

Hot Dot product literature, printed Sep. 15, 2008.

*Primary Examiner* — Richard A Smith
(74) *Attorney, Agent, or Firm* — Boyle Fredrickson, S.C.

(57) ABSTRACT

A bow sight automatically corrects and compensates for various dynamically changing aiming, shooting, and/or environmental conditions. The bow sight can perform situation-specific aim evaluations and corrections to correct or compensate for situation-specific shooting and environmental factors, at a given time and on a per-shot basis. The bow sight includes integrated sensor-type devices, such as a range finder, an inclinometer, and an anemometer, which detects values of situation-specific shooting and environmental factors and communicates such detected values with a processor or other control device. The processor uses the situational specific data, as well as bow and arrow performance data, and data from shot calibrations, to calculate precise vertical and horizontal aim compensations required to accurately hit the desired target point. The bow sight displays a new crosshair, dot, or multiple dot set, to direct the archer to a situation-specific aiming point for the most accurate shot under those particular circumstances.

26 Claims, 10 Drawing Sheets

U.S. PATENT DOCUMENTS

| | | | | |
|---|---|---|---|---|
| 8,081,298 | B1 * | 12/2011 | Cross | 356/4.01 |
| 8,100,044 | B1 * | 1/2012 | Teetzel et al. | 89/41.17 |
| 2005/0021282 | A1 * | 1/2005 | Sammut et al. | 702/150 |
| 2005/0229468 | A1 * | 10/2005 | Zaderey et al. | 42/122 |
| 2006/0272194 | A1 * | 12/2006 | Guettner | 42/122 |
| 2007/0068018 | A1 | 3/2007 | Gilmore | |
| 2007/0137088 | A1 * | 6/2007 | Peters et al. | 42/111 |
| 2007/0234626 | A1 * | 10/2007 | Murdock et al. | 42/126 |
| 2007/0277421 | A1 * | 12/2007 | Perkins et al. | 42/122 |
| 2008/0039962 | A1 * | 2/2008 | McRae | 700/90 |
| 2008/0107414 | A1 | 5/2008 | Showalter | |
| 2009/0205239 | A1 * | 8/2009 | Smith, III | 42/122 |
| 2011/0296699 | A1 * | 12/2011 | Mainsonneuve et al. | 33/228 |
| 2012/0046100 | A1 * | 2/2012 | Rom n et al. | 463/30 |

* cited by examiner

AUTO-CORRECTING BOW SIGHT

CROSS-REFERENCE TO RELATED APPLICATIONS

This application claims priority under 35 U.S.C. §119 from U.S. Provisional Patent Application Ser. No. 61/112,835, filed on Nov. 10, 2008 and entitled "AUTO-CORRECTING BOW SIGHT," which is herein expressly incorporated by reference in its entirety, for all purposes.

BACKGROUND OF THE INVENTION

1. Field of the Invention

The invention relates generally to hunting accessories and, more particularly, to devices for bow sighting devices for establishing aiming positions while using a bow.

2. Discussion of the Related Art

Archery sports are growing in popularity and include, e.g., hunting, conventional target shooting, 3-D target shooting, electronic video mock hunting, and other activities. Archery technology has progressed over time, with some of the most notable technological advancements occurring within the last few decades. Notable examples of such advancements include the development of (i) compound bows that allow an easier bowstring draw and corresponding lower forces for holding full-draw position of bowstrings, and higher and more consistent arrow exit velocity, and (ii) trigger-type releases which allow a release that prevents jerk and moving off the target at bowstring release.

Furthermore, modern archery bow and arrow systems typically include various aiming devices to improve shooting consistency. Such aiming devices are commonly referred to as "sights" and allow archers to, after sighting in the bow, align an end of a pin with an intended arrow striking position on a target. Although sights assist an archer's aim, numerous attempts have been made to improve shooting consistency with archery bows and arrows. For example, peep sights have been provided to allow archers to look through small portions of their bowstrings at a fully drawn position to improve consistency of vertical sighting positions. Other position consistency devices include "kisser-buttons" or other anchor point devices that provide a physical structure on the bow that contacts a reference point on the archer's body to improve consistency of a bow-holding position and orientation prior to firing or releasing an arrow.

Such shooting consistency aids and sights have at least some drawbacks. Pin-based sights typically include multiple sight pins that are vertically spaced from each other and positioned such that different pins are used for shots of different yardages. A cluster of multiple pins can, at times, at least partially obscure a line of sight of the archer. Additionally, accurate use of a multiple pin sight requires accurate range or target estimation by the archer. Accurately estimating range can prove difficult for archers, especially in, e.g., an actual hunt with game animals that are amongst obstacles and/or moving so that an actual shooting distance varies over time. At times, archers estimate shooting distances that do not correspond wholly to a single pin, whereby the archers must recall which pins are used at certain distances and then aim between such pins. Compounding this difficulty is that from a tree stand not only the distance changes but so does the shooting angle both of which need to be quickly estimated along with their effects on pin selection.

Various attempts have been made to resolve such distance estimating difficulties. Such attempts include utilizing laser-based range finders to accurately measure distances. However, such laser-based range finders take time to calculate the desired distance. Furthermore, such laser-based range finders are handheld or stand-alone units requiring archers to use their hands to manipulate, preventing them from grasping their bows in a shooting alert manner and determine a target distance simultaneously, whereby they cannot draw the bow and utilize the range finder at the same time. At times, the game animal does not stay still long enough for the archer to draw and release an arrow after finding the range to the animal, whereby the shot opportunity is lost due to the time required for shot preparation.

Besides estimating shooting distances, there are other factors that archers must consider while taking aim that are typically dynamically changing which are not resolved by utilizing known shooting consistency devices. Such dynamically changing factors include shooting angle and wind factors. Shooting angle, shot angle, or the vertical angle at which an archer holds a bow influences arrow flight ballistics, whereby an archer must try to predict and compensate for these influences based on the particular angle of the bow for each shot.

Attempts have been made to compensate for such shooting angle issues by providing "pendulum-type" sights that swing and remain vertical with respect to the ground. Such pendulum-type sights require moving components that can be damaged, misaligned, or otherwise harmed by brush or other obstacles while traversing a field, woods, or other habitat on the way to one's hunting stand, and the pendulum-type sight may not compensate for all angles, elevations, and distances.

Regarding wind factors such as direction and speed, handheld or stand-alone anemometers are known. Such handheld or stand-alone anemometers suffer the same drawbacks as discussed above with respect to the laser-based range finders. Namely, the handheld or stand-alone anemometers require an archer to physically manipulate them and correspondingly let go of the bow while determining the wind characteristics. Then, once the wind characteristics are known, the archers must once again use their best judgment on how the wind characteristics should be compensated for, and then adjust their aims accordingly by, e.g., laterally or vertically displacing the sight pin from the desired arrow strike position on the target.

In light of the foregoing, a bow sight is desired that improves the state of the art by overcoming the aforesaid problems of the prior art.

SUMMARY OF THE INVENTION

In accordance with one aspect of the invention, a bow sight is provided that allows an archer to take "dead aim" or aim directly at a target, at all times, by illuminating or otherwise displaying an aim indicator(s) that is positioned so as to compensate for situation-specific shooting and environmental factors that influence arrow flight. This can be all done while the bow is at full draw and ready for the shot.

In accordance with another aspect of the invention, a bow sight is provided that automatically corrects and compensates for various dynamically changing aiming, shooting, and/or environmental conditions. The bow sight can include various integrated sensors or other sensing-type devices, such as a range finder, an inclinometer, and an anemometer, which communicate with a processor or other control device. The processor, based on, e.g., signals from the sensors, may illuminate one or more aim indicators provided within a sight array which includes multiple aim indicators. In this configuration, a default sighted-in position can be preliminarily established and designated by a first aim indicator provided within the sight array. Then, during use, the system can correct and compensate for factors such as distance, shot angle and windage settings. In so doing, effects of environmental and use influences can be mitigated by changing a discrete position of the aim indicator within the sight array based on, e.g., shooting angle, wind direction, wind velocity, shot distance or other factors.

In accordance with yet another aspect of the invention, a method of providing and using a bow sight. The method can include providing a bow sight having (i) a base member attachable to a bow, (ii) a sight array that has multiple electronically selectively tightly spaced displayable aim indicators, (iii) an inclinometer, (iv) a range finder, and (v) a processor that cooperates with the inclinometer, range finder, and sight array. The inclinometer transmits a signal relating to a shooting angle to the processor. The range finder transmits a signal relating to a shooting distance to the processor. Based on such signal(s), the processor determines which aim indicator within the sight array should be illuminated, and correspondingly illuminates such aim indicator.

In yet another aspect, once installed on a bow and preliminarily sighted in, the bow sight can be entirely self-reliant and dynamically re-sighted in, or aim-corrected on a per-shot basis, based on the particular use or environmental conditions at a particular point in time. Changes can be made to the bow dynamics or the arrow choice and can be easily inputted or sighted in at a practice range to accommodate such changes.

According to other aspects, when it is desired to activate the bow sight, a user can depress a trigger upon or otherwise manipulate controls of the bow sight, initiating one or more of the multiple functions of the bow sight, in so doing. A processor can evaluate distance and angle-related signals determined by the range finder and inclinometer and display or illuminate a particular aim indicator while actively targeting the bow. In a preferred embodiment, the bow sight displays or illuminates an exact target dot LED, as the aim indicator, within a yard of the exact range distance and so within about an inch of the perfect target spot optimum. Such aim indicator is not a yardage or range pin, such as those of the prior art, since, for example, each of the aim indicators is usable for a variety of different distances depending on various other situation-specific shooting and environmental factors at a given time.

According to some aspects, the bow sight is further configured for windage or other wind-related correction by utilizing the anemometer to determine prevailing wind characteristics and transmits at least one wind-related signal to the processor for evaluating whether an aim correction is required. In some embodiments, side wind direction and velocity can be sensed or determined for correcting windage. Head wind or tail wind direction and velocity can also be sensed or determined, for example, by way of a second anemometer or a component of the first anemometer that is positioned in a forward or rearward-facing direction for detecting head or tail winds. The head or tail wind-detecting anemometer can be implemented for correcting an elevation or vertical angle of arrow release since, e.g., shooting into a direct head wind of about 30 miles per hour may require an archer to elevate or vertically compensate by shooting higher than the archer would if there was no wind influence, in light of a corresponding arrow drop value associated with shooting into such head wind. Various wind components such as side winds, head winds, and tail winds can therefor be compensated for, independently of each other, or in a combined wind-related compensation procedure.

In some aspects, the aim indicators may be spaced from each other to accommodate shooting distance increments of less than about three yards, and preferably of no more than about one-yard increments.

The bow sight can further include an anemometer that transmits wind-related signals to the processor. Preferably, the wind-related signals correspond to wind direction and/or wind velocity. This information can affect the ideal sighting position of the bow in both the vertical and the horizontal planes.

The bow sight can perform situation-specific aim indication displays and/or automatically perform various aiming corrections. For example, a windage correction step can be performed by illuminating an appropriate aim indicator based on the wind-related signal(s). As another example, an elevation or distance correction can be performed by illuminating an aim indicator based at least in part on shooting angle-related signals.

In yet another aspect, the method includes establishing a default sighted-in position of an aim indicator provided on a bow, evaluating a shooting distance defined between the bow and a target, and evaluating a vertical shooting angle of the bow. A correcting procedure may be performed by automatically illuminating an aim indicator that is spaced from the default sighted-in position, based on the evaluated shooting distance and vertical shooting angle. The aim indicator moving correcting procedure may be performed automatically to compensate or correct for wind speed and/or wind direction, instead of or in addition to the previously mentioned shooting distance and angle values.

The bow sight may be configured to allow an archer to input bow and arrow characteristics, including speed and ballistics information, into the bow sight, allowing a processor within the bow sight to use predetermined tables stored in memory to optimize the aim indicator display performance, that is, the bow sight's situation-specific shooting and environmental factor compensation performance, without need for practice range manual calibration. This can provide a pick up and shoot capability in the field, with no further correction required. Such bow and arrow characteristic inputs can be accessed on-line from a vendor website or otherwise electronically obtained from a vendor, based on manufacturer and model information. A PC-to-bow sight interface, such as a USB cable, a wireless interface, or other suitable interface, can be used to access pull down menus from the vendor's website for the manufacturer make and model of the bow, the arrow, the fletching, the broadhead, etc. to input the true ballistic information to the bow sight, for example, as correction calibration setups.

A display may visually and/or audibly convey to an archer various information relating to environmental or other conditions that may be considered during an aim-correcting procedure. For example, at least one of the (i) shooting distance, (ii) vertical shooting angle, and (iii) wind speed and/or direction can be displayed to a user. The display can further indicate at least one of, e.g., a time of day, a legal hunt beginning time, a legal hunt ending time, a time remaining until the legal hunt beginning time, and a time remaining until the legal hunt ending time.

In further aspects, the sight array may include multiple vertically aligned aim indicators. The sight array may also include multiple horizontally aligned aim indicators. The vertical and horizontal aim indicators may illuminate independently with respect to each other such that, in combination, they can define discrete points of intersection that are movable within the sight array depending on which vertical and horizontal aim indicators are illuminated at any given time.

The aim indicators may define discrete dots within the sight array. The sight array may include a see-through panel that selectively illuminates discrete dots and/or crosshairs, as precise aim indicators at calculated aiming positions.

Other features and advantages of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference characters represent like parts throughout.

DETAILED DESCRIPTION OF THE PREFERRED EMBODIMENTS

Figure 1:
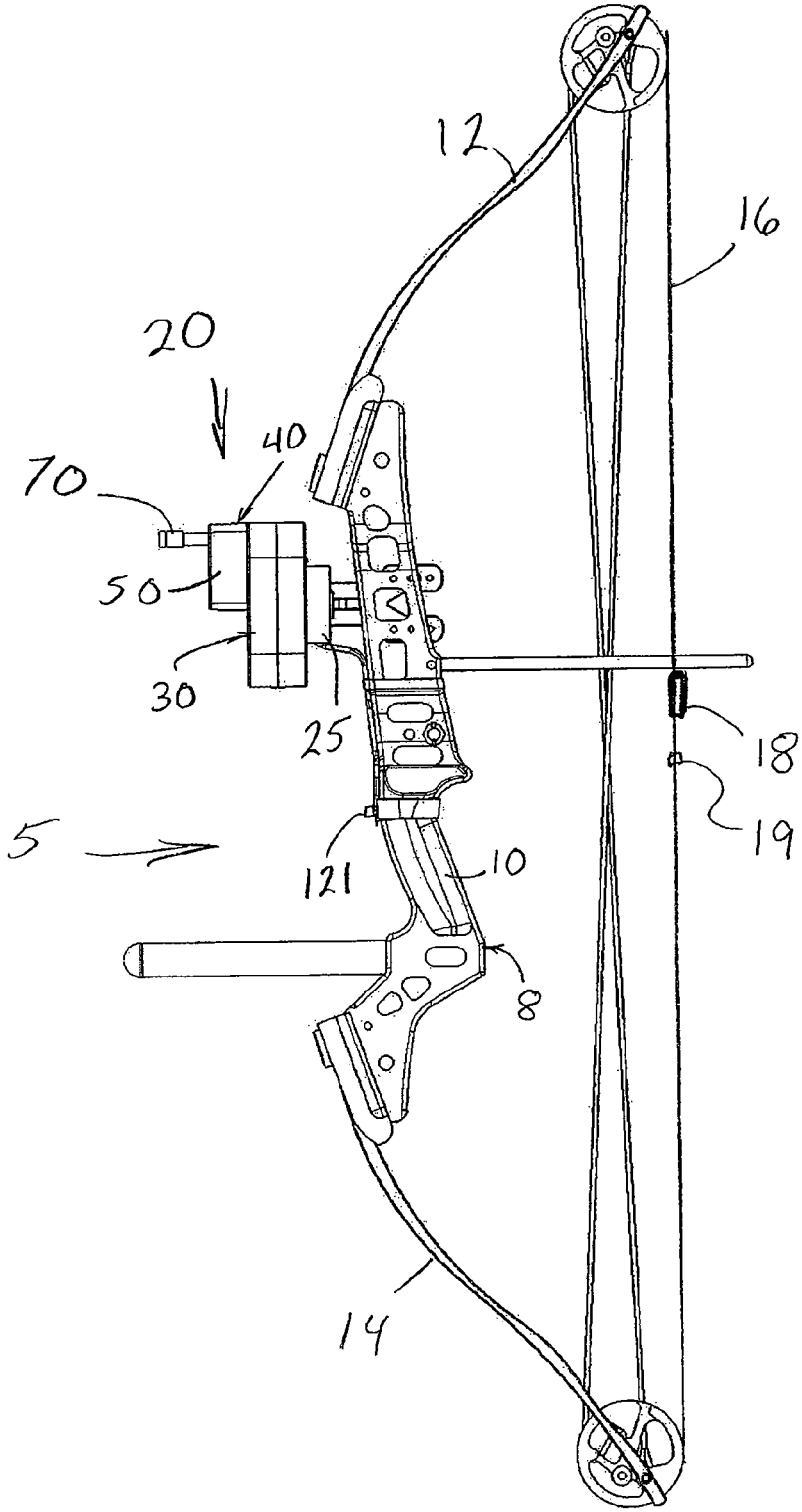
FIG. 1 is a perspective view of an archery bow incorporating a bow sight according to a first embodiment of the present invention.

As discussed in the "Summary" section above, the invention relates to a bow sight that compensates for situation-specific shooting and environmental factors that can influence arrow flight, for example, by performing a situation-specific aim evaluation and correction procedure. The preferred bow sight has selectively illuminating or displayable aim indicators that are illuminated or otherwise visually or audibly displayed at positions which compensate for such situation-specific shooting and environmental factors in a manner that allows an archer to take "dead aim" with, or aim directly at, an intended target at all times.

Various embodiments of a bow sight will now be described that achieve these and many other goals, it being understood that other configurations may be provided that fall within the scope of the present invention. Such exemplary embodiments of the bow hunting accessory device of the present invention are illustrated in the accompanying drawings in which like reference numerals represent like parts throughout.

1. Bow Sight Overview

FIG. 1 show an automatically correcting bow sight 20 incorporated as a single multi-functional unit onto a bow 5. Bow sight 20 of this embodiment is configured so that, once it is set up and calibrated, it selectively displays an aiming indicia that is located at a calculated aiming position in a manner that fully compensates for, e.g., situation-specific shooting and environmental factors that can influence arrow flight characteristics, allowing an archer to take dead aim upon an intended impact position on a target, regardless of distance, bow angle, wind, and/or other arrow flight influencing factors.

Still referring to FIG. 1, bow 5 can be a typical compound archery bow having a riser 8 that serves as a main central body portion having an integral handle 10 for holding the bow 5. Upper and lower limbs 12 and 14 extend from upper and lower portions of the riser 8. Cams are operably mounted to opposing ends of the limbs 12 and 14 and provide mounting substrates to which the bowstring 16 is attached. A peep sight 18 may be provided in or on the bowstring 16, above an arrow nock 19, allowing an archer to peer through the peep sight 18 while utilizing the bow sight 20. Peep sight 18 is preferably a conventional and commercially available peep sight. When used in combination with the bow sight 20, peeps sight 18 is usable as an aiming tool, in a typically sense, and also may be used by the archer while implementing the bow sight 20 to evaluate the situation-specific shooting and environmental factors, explained in greater detail elsewhere herein.

Referring generally now to FIGS. 1-8, bow sight 20 includes a base 25, a sight array 30, a sensor system 40, and control and display system 100. The sight array 30 and sensor system 40 cooperate with each other to automatically or otherwise compensate for various dynamically changing aiming, shooting, and/or environmental conditions. In this regard, the bow sight 20 can be properly sighted for various shooting ranges, and the bow sight 20 will adjust and self-correct to allow a corrected crosshair or other sight line or indicia to be displayed for alignment with the target. Stated another way, one or more aim indicia is selectively displayed in a manner that obviates the prior art's requirement for an archer to manually compensate by aiming higher than, lower than, to the left of, or to the right of, or otherwise misalign a yardage pin with respect to an actually-intended arrow strike location upon a target.

Bow sight 20 can account or compensate for variations in or characteristics of, e.g., (i) a range or distance between a bow and a target, (ii) an angle to the horizontal, (iii) ballistic characteristics of arrows, (iv) velocities of arrows at instances of shot release from particular bows, (v) jerk tendencies that an archer may display at moments of arrow release, and (vi) various dynamically changing environmental factors including wind speed and direction. Bow sight 20 automatically adjusts its setting and configuration based on such variations or characteristics. Bow sight 20 therefore allows an archer to always take "dead-aim" without having to over-aim, under-aim, or otherwise employ aim-compensation techniques. This is because the auto-correcting functionality of bow sight 20 ensures that, at any given time, the bow sight 20 is properly sighted in for that particular bow configuration, arrow ballistics, shooting distance, shooting inclination, angle, or elevation, as well as wind-heading direction and velocity. Stated another way, bow sight 20 dynamically sights itself in, on a "per-shot" basis, by deviating a displayed or illuminated position of an aim indicator, with respect to a previously established default aim position, as a function of situation-specific shooting and environmental factors that can influence arrow flight characteristics. This can be done automatically or as desired and directed by the archer. The components of bow sight 20 will now be described in greater detail.

2. Base and Sight Array

Figure 3:
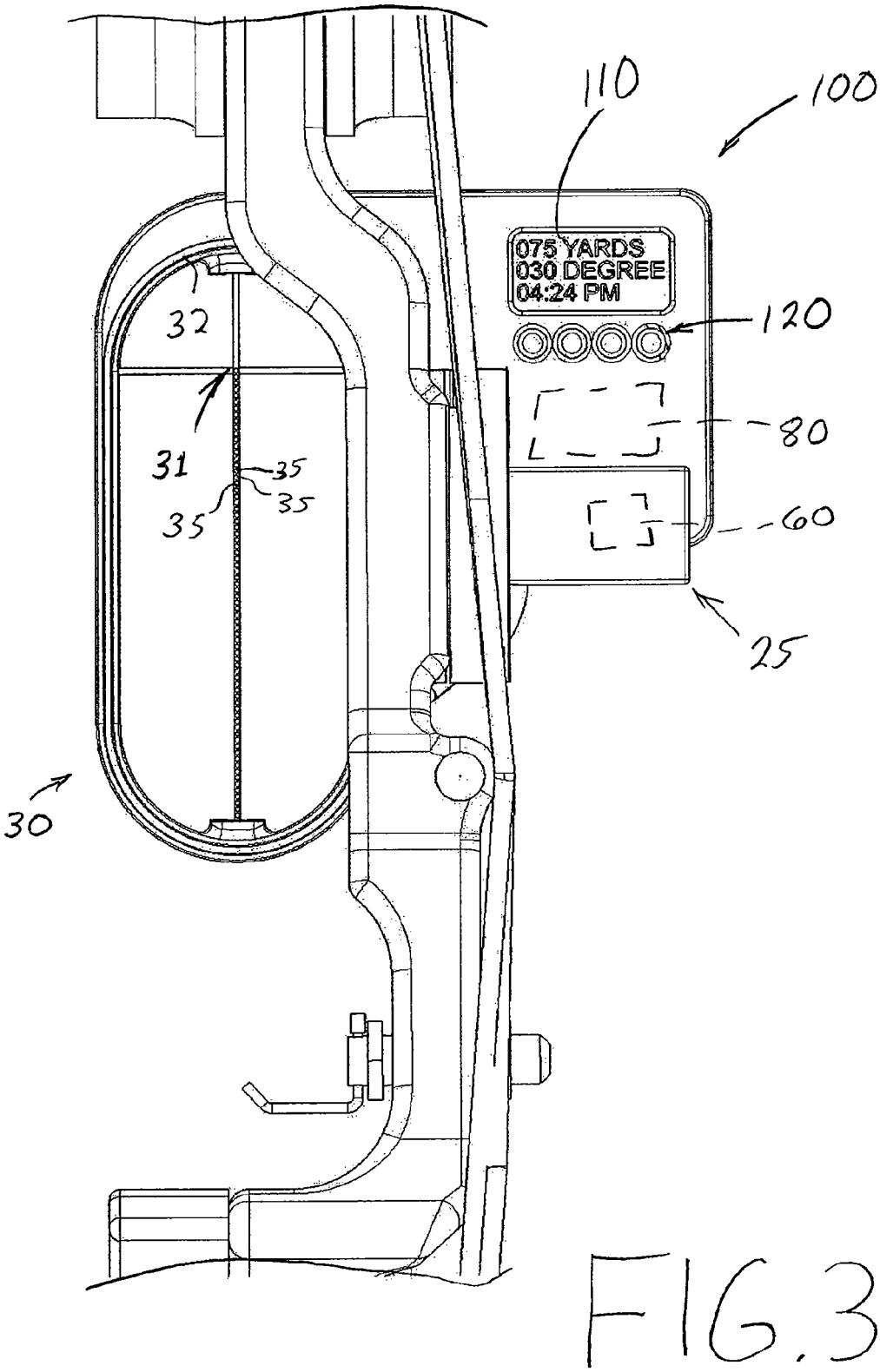
FIG. 3 is a back elevation of a variant of the bow sight of FIG. 1.
Figure 5:
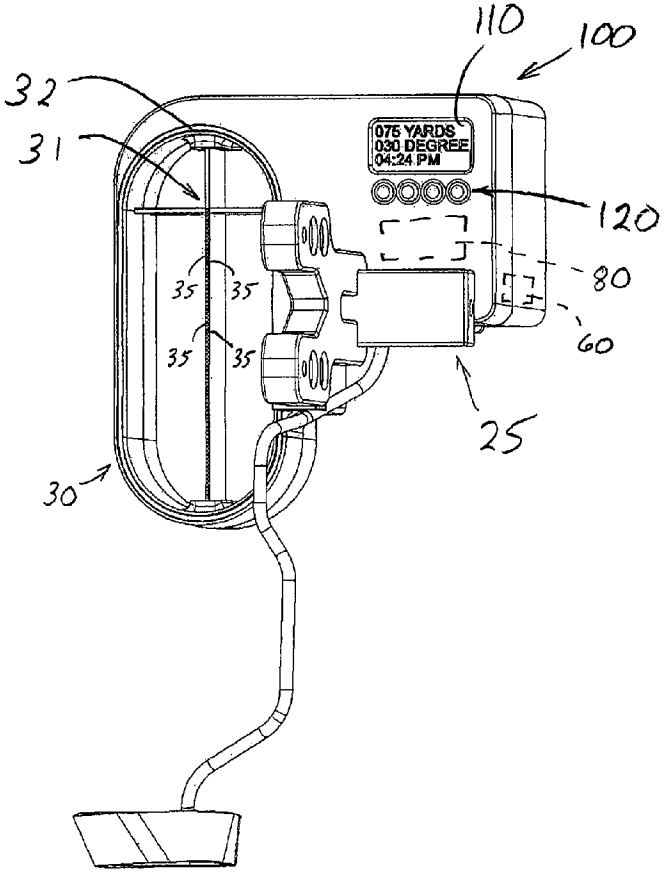
FIG. 5 is a pictorial view of the back of the bow sight of FIG. 3.
Figure 6:
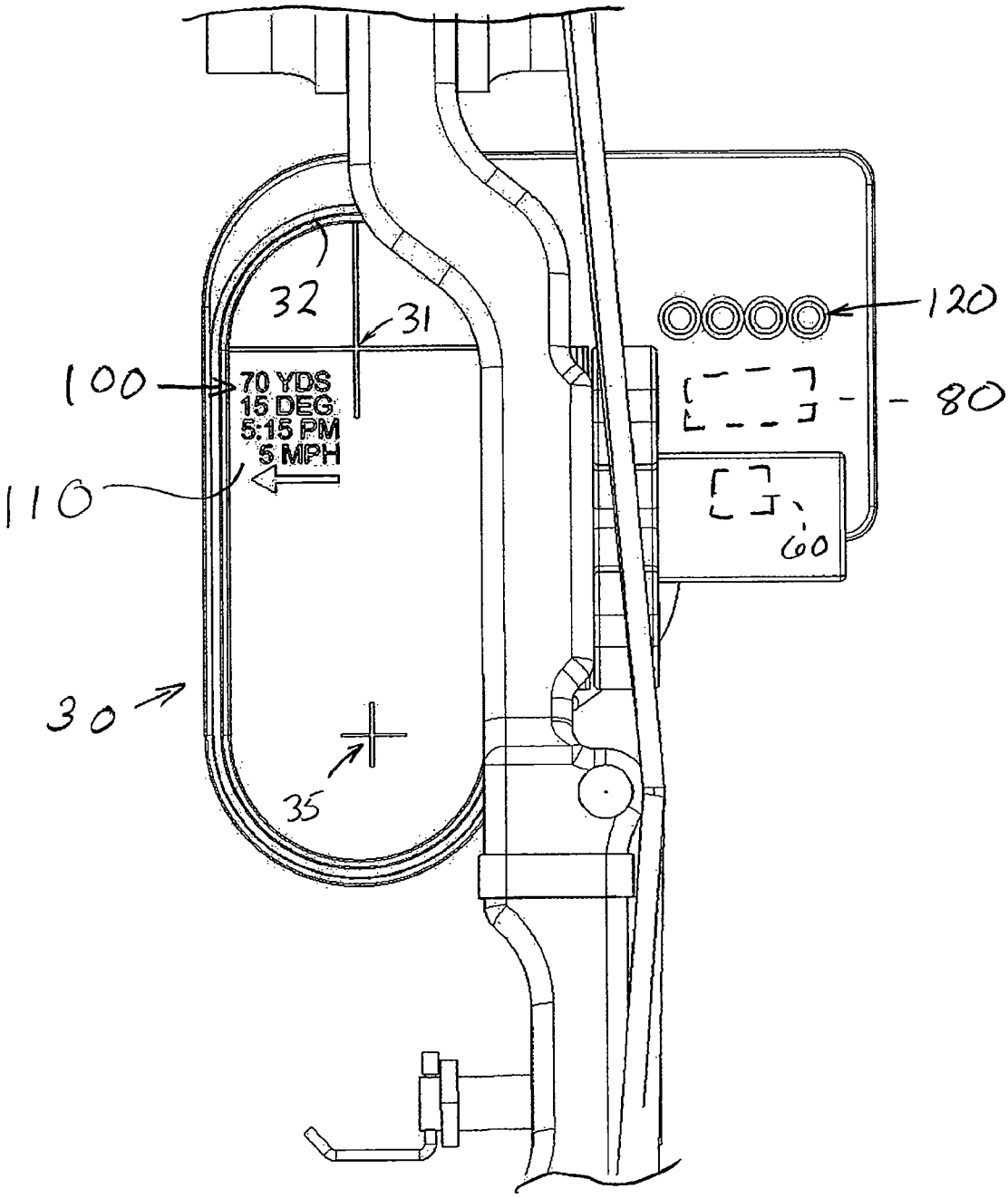
FIG. 6 is a back elevation of the bow sight of FIG. 1.

Referring now to FIGS. 3-8, base 25 can attach directly to riser 8 of bow 5 and preferably houses or provides mounting structure for the remaining components of bow sight 20. Sight array 30 extends from the base 25 and provides, e.g., variably or selectively displayable, illuminating, or movable aiming indicia. Sight array 30 also provides a targeting sight 31 that is best seen in FIGS. 3 and 6. Targeting sight 31 preferably has a cross-hair type configuration and further includes a crown 32 that extends in an arc across the top of the targeting sight 31. The crown 32 is configured to align and register when viewed through an archer's aiming eye, with an upper perimeter edge of a peep sight 18 opening while performing a shot-distance or other situation-specific evaluation as described in greater detail elsewhere herein and as seen in FIG. 9. Sight array 30 may also provide audible indicia that assist in aiming.

Figure 10:
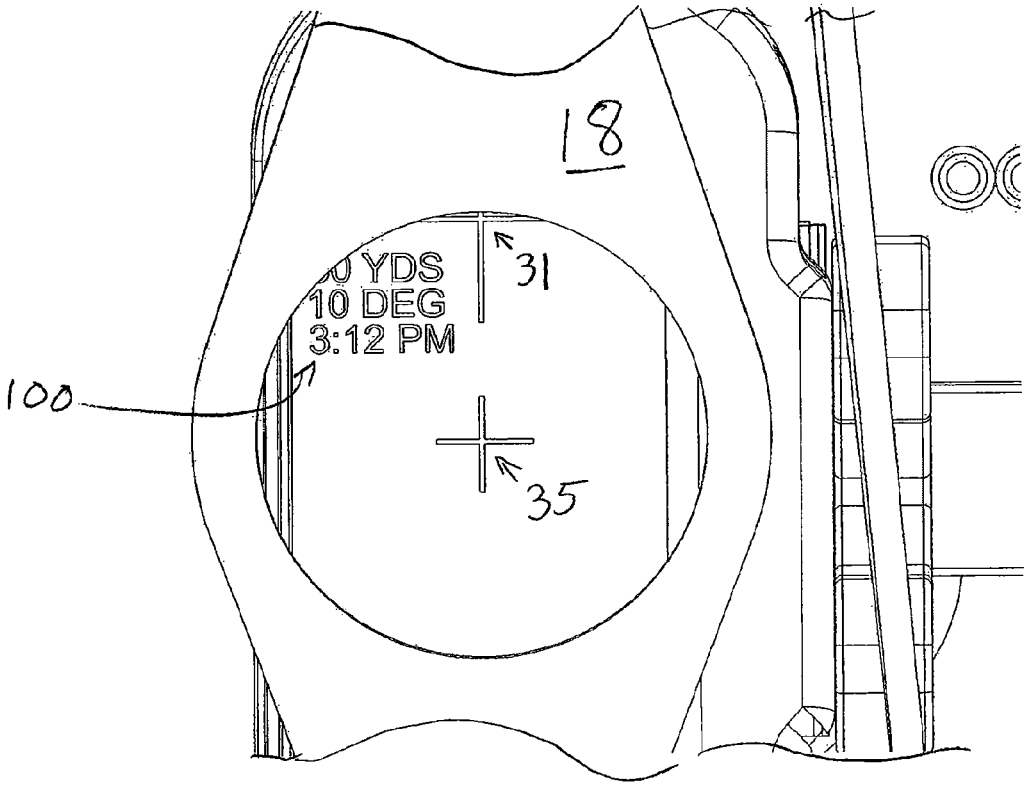
FIG. 10 is a back elevation view of an aim indicator being viewed through a peed sight.

Still referring to FIGS. 3-8, the particular configuration and "look" or appearance of sight array 30 of this embodiment is selected to provide the desired end use display characteristics. For example, the sight array 30 can display or illuminate aiming indicia as one or more of (i) discrete dot-like aiming indicia, (ii) elongate vertical aiming indicia, (iii) elongate horizontal aiming indicia, (iv) crosshair type or other intersecting elongate aiming indicia, and/or (v) others. The aiming indicia provided by the sight array 30 include one or more aim indicators 35. Each of the aim indicators 35 is alignable with the peep sight 18 and can be placed in or along the archer's line of sight, while looking through the peep sight 18, allowing the archer to visually place the aim indicator(s) 35 upon intended arrow strike location of the target, for example, as seen in FIG. 10.

Still referring to FIGS. 3-8, the aim indicators 35 are selectively displayable so that, when aiming and shooting, only the one or more aim indicators 35 that are positioned at a calculated aiming position are visually conspicuous to the archer. Accordingly, in a normal default state, most or all of the aim indicators 35 are not illuminated or otherwise visually conspicuous. However, during a situation-specific aim evaluation and correction procedure, a particular aim indicator 35 is illuminated or displayed at a position that corresponds to a calculated or adjusted aiming position that corrects or compensates for one or more of, for example, shooting distance or range, vertical shooting angle, wind speed, and/or wind direction explained in greater detail elsewhere herein.

Referring now to FIGS. 4-5 and 7-8, the intensity of the illumination of aim indicators 35 can be varied or adjusted, either manually or automatically. For implementations that include such variable or adjustable illumination intensities, the sight array 30 preferably also includes an ambient light sensor 33 that can include, for example, one or more ambient light-sensing avalanche diodes or other ambient light sensing devices and corresponding controls. Regardless of the particular configuration of the sight sensor 33, it cooperates with and illuminates or otherwise displays one or more aim indicators 35, optionally, to variably display or illuminate intensity so that the aim indicators 35 are brighter when there is more ambient light and dimmer when there is less ambient light to minimize eyestrain by the archer. This may be accomplished, by providing aligned LEDs (light emitting diodes) as the aim indicators and suitably controlling their output intensity in a known manner.

Figure 11:
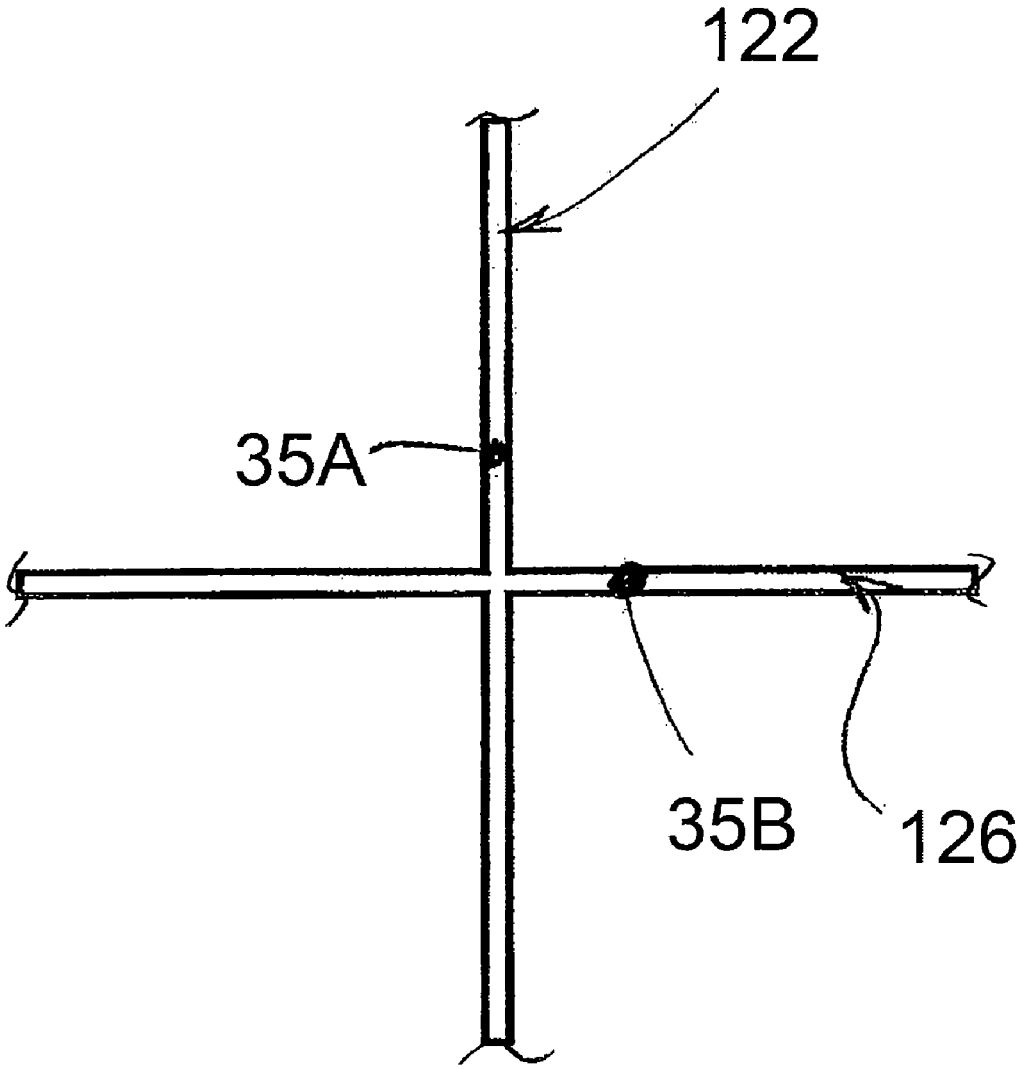
FIG. 11 is a schematic view of a variant of the sight array of the bow sight of FIG. 3.

Referring now to FIG. 11, multiple aim indicators 35 can be provided in close proximity to each other within a single mounting structure or substrate, such as a vertical light bar 122 and/or a horizontal light bar 126. The vertical light bar automatically outputs, illuminates, or displays a vertical aiming dot 35A. The position of the vertical aiming dot 35A is calculated or determined so as to compensate for variables or factors that influence a height component of arrow flight, such as distance, headwinds, and/or other arrow drop effectuating stimulus. Generally the same is true for the horizontal light bar 126, whereby the horizontal light bar 126 automatically outputs, illuminates, or displays a horizontal aiming dot 35B. The position of the horizontal aiming dot 35B is calculated or determined so as to compensate for variables or factors that influence a transverse component of arrow flight, such as windage effectuating stimulus, which can be a potentially large factor in arrow flight characteristics. In such embodiments, the archer is given independent vertical and horizontal compensation indication lights by way of the vertical and horizontal aiming dots 35A, 35B. The archer therefore aims at an estimated position by vertically aligning the vertical dot 35A to the height of the intended strike position on the target and horizontally aligning the horizontal dot 35B with the intended strike position on the target.

Figure 8:
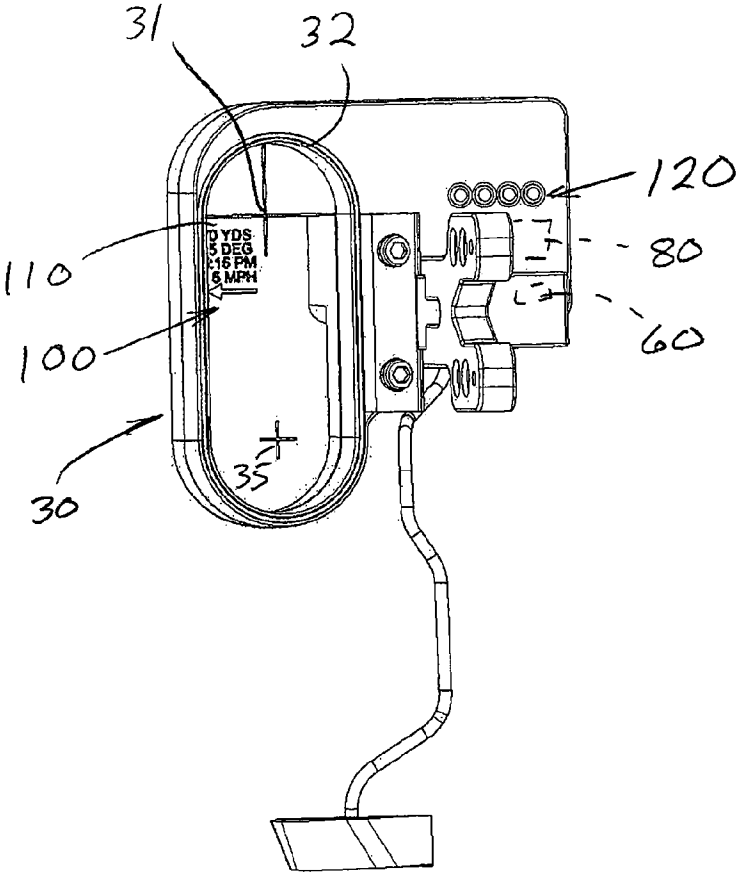
FIG. 8 is a pictorial view of the back of the bow sight of FIG. 1.
Figure 7:
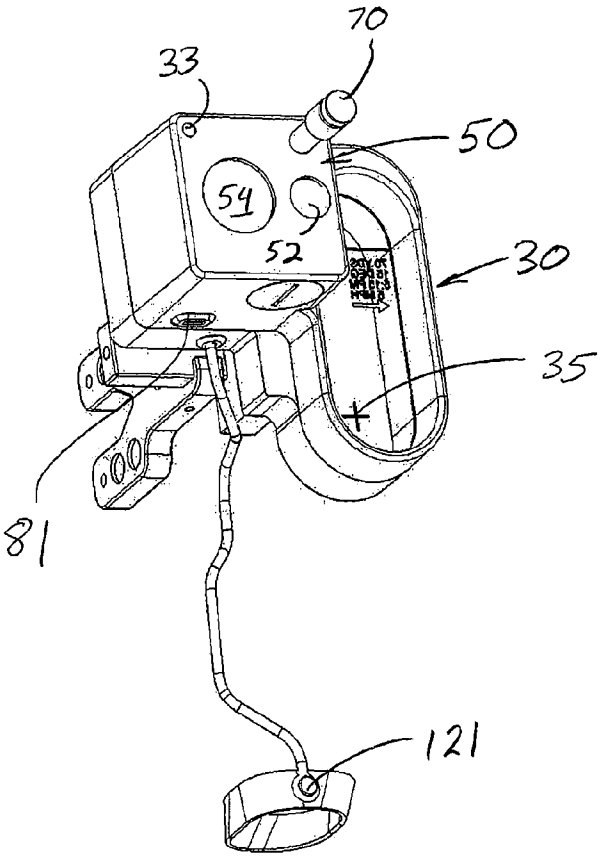
FIG. 7 is a pictorial view of the front of the bow sight of FIG. 1.
Figure 9:
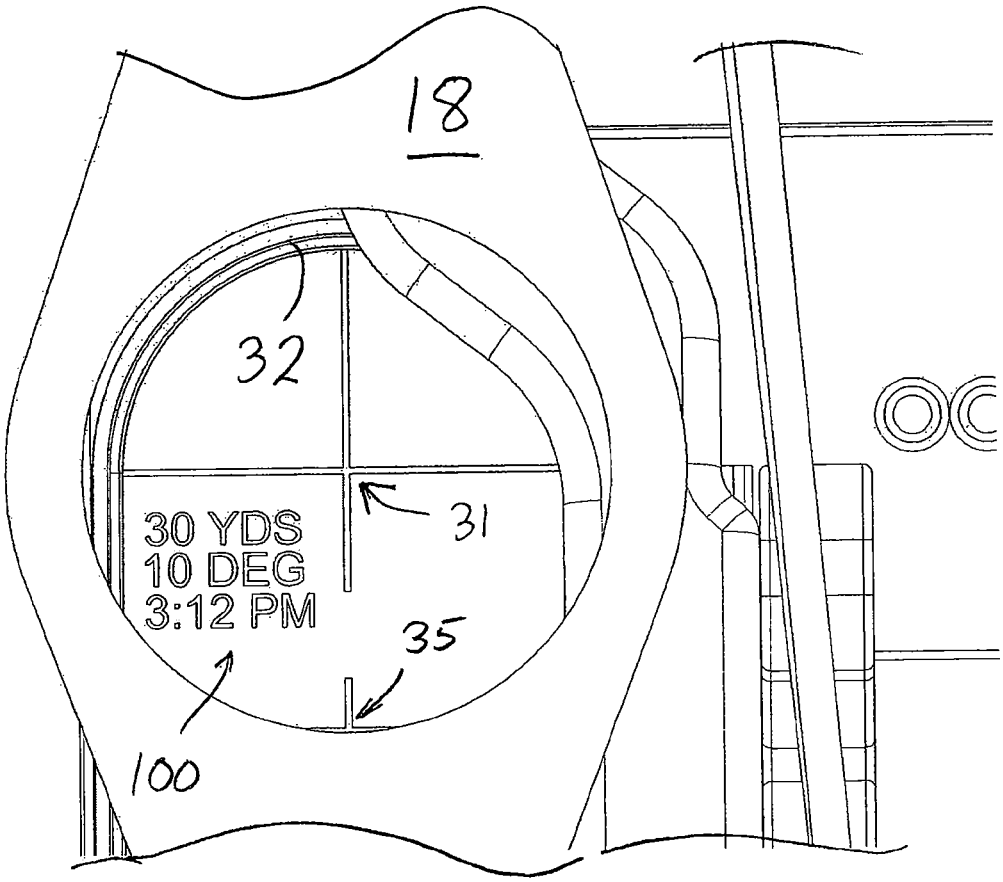
FIG. 9 is a back elevation view of a targeting sight being viewed through a peep sight.

Referring now to FIGS. 6-8, the illuminated or displayed aim indicators 35 of this embodiment are located at precisely the calculated aiming positions, negating the need for the archer to envision projecting and/or intersecting lines from the aiming dot(s) 35A, 35B. This is accomplished by providing a transparent or see-through panel display as the sight array 30 or at least as a part thereof. The see-through panel display shows the aim indicators 35 as dots, crosshairs, or other aiming indicia depending on the particular end use configuration of the bow sight 20. Suitable see-through panels include, for example, (i) see-through liquid crystal displays (LCDs) which can selectively blacken areas to draw crosshairs, letters, and numbers, (ii) organic light-emitting diode (OLED) displays which can be multi-colored, (iii) fast supertwist nematic (FSTN) displays, and/or others.

Alternatively, the illuminated or displayed aim indicators 35 may be located at precisely the calculated aiming positions, but without implementing the see-through panel display of FIGS. 6-8. This can be accomplished by again providing multiple aligned LEDs (and/or other lights) as the aim indicators 35 in an LED bank(s) from which fiber optic strands, or light pipes extend. Such fiber optic strands or light pipes can define, in combination, a discontinuous web or mesh that has fibers or other portions that are selectively illuminated by the aim indicators 35 so that the aim indicators 35 and their cooperating strands or pipes intersect to define intersecting crosshairs at the calculated aiming positions. The webs or meshes of this embodiment are substantially translucent or even transparent, allowing an archer to see through the webs or meshes relatively easily, in order to suitably visually identify the target. This makes the webs or meshes largely analogous to the see-through panel display discussed above, only defining a discontinuous surface thereof.

Regardless of the particular configuration of aim indicators 35, or the devices which may illuminate or otherwise display the aim indicators 35, the particular aim indicator that is illuminated or displayed at any given time is selected based on its position such that taking "dead-aim" or aiming directly at a target with the aim indicator 35 suitably corrects or compensates for situation-specific shooting and environmental factors that can influence arrow flight. Such situation-specific shooting and environmental factors are evaluated or detected by sensor system 40.

3. Sensor System

Figure 4:
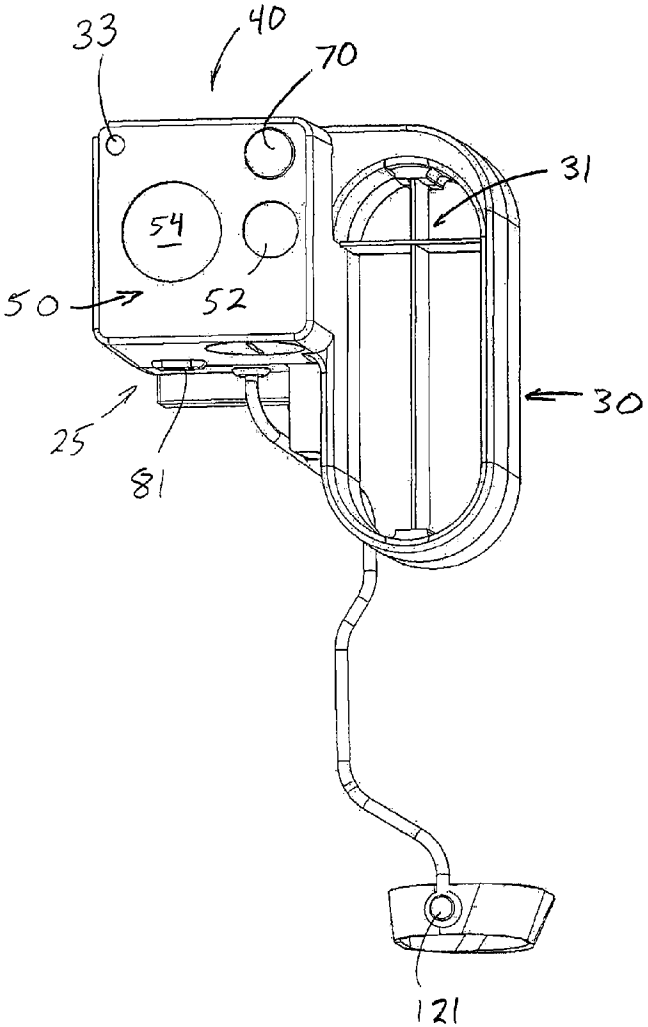
FIG. 4 is a pictorial view of the front of the bow sight of FIG. 3.

Referring now to FIGS. 4 and 7, sensor system 40 preferably is housed in the base 25. It preferably includes a processor 80 as well as one or more of a range finder 50, an inclinometer 60, and an anemometer 70. The sensor system 40 can use data collected from the sensors to monitor particular use conditions and control the sight array 30, instructing it to take corrective action based on such use conditions at a particular point in time based on input triggering. Stated another way, by manipulating various controls 120 (explained in greater detail elsewhere herein) an archer can force the bow sight 20 to perform an aim correction. Optionally, multiple aim corrections can be performed by manipulating the controls 120 a corresponding number of times. These inputs can also be used to input specific equipment data such as bow velocity, arrow weight and other pertinent ballistic information.

Still referring to FIGS. 4 and 7, range finder 50 can include a laser 52 that emits columnated light therefrom and a detector or receiver 54 that receives reflected light. The emitted and reflected light is preferred infrared or otherwise non-visible. A suitable laser/detector assembly is available from any of a variety of manufacturers, including but not limited to, e.g., Bushnell, Nikon, Leika, and other suppliers. Inclinometer 60 is configured to detect a vertical angle of inclination or shooting angle of the bow 5, and is preferably housed entirely within the base 25 of bow sight 20. A suitable inclinometer is available from any of a variety of manufacturers, including but not limited to, e.g., Bushnell, Nikon, Leika, and other suppliers, and is preferably a 3-axis or 3D accelerometer based device.

Referring still to FIGS. 4 and 7, the anemometer 70 is as open to the environment as possible to sense wind velocity and/or direction. Anemometer 70 measures at least the wind velocity and also preferably measures wind direction relative to the archer's aiming direction. Stated another way, anemometer 70 can sense potentially lateral or transverse flight path influencing side winds, potentially decelerating head winds, or potentially accelerating tail winds, allowing such wind-related factors to be compensated for, independently or otherwise. This permits aiming compensation for the lateral as well as vertical and/or other flight direction related wind speed effects on the flight of the arrow.

Figure 2:
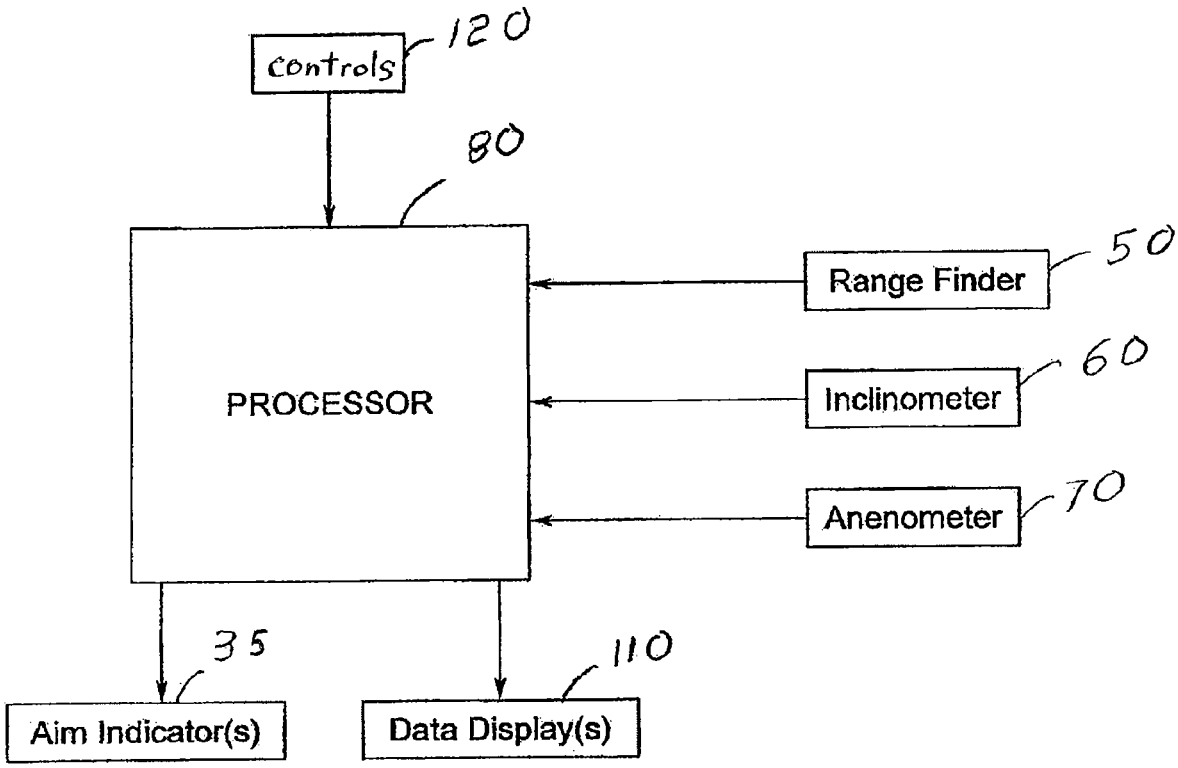
FIG. 2 schematically illustrates the electronic components of the bow sight of FIG. 1.

Referring now to FIGS. 2, 5, and 7, processor 80 preferably is housed entirely within the base 25. Processor 80 includes any suitable computing resource(s) such as, for example, a memory device and a microprocessor with an operating system that cooperates with the memory device. The processor 80 can receive and store, for example, on the memory device, bow and arrow characteristic data directly from the user's computer. This data may be acquired, e.g., from the bow sight manufacturer's website. Models are user selectable and can be changed as the archer modifies his/her equipment. Processor 80 also dynamically receives signals that are transmitted from the range finder 50, inclinometer 60, and anemometer 70 and determines if an aim indicator 35 correction should be made, and, if so, what correction should occur. Processor 80 thus serves as a decision maker and a controller of the bow sight 20.

4. Display System

Referring again to FIGS. 5, 6 and 7, control and display system 100 includes display 110 and controls 120. The control and display system 100 is configured to convey information to the archer regarding various use or environmental conditions. For example, the display 110 can display such data as shooting distance, shooting angle, wind speed and direction, or other information, depending on the particular configuration of processor 80 and/or the display system 100, itself. In yet other implementations, the display 110 can show at least one of, e.g., a time of day, a legal hunt beginning time, a legal hunt ending time, a time remaining until the legal hunt beginning time, and a time remaining until the legal hunt ending time, or other information as desired. Regardless of the particular information that is being conveyed by the display 110, it may be incorporated into the bow sight 20 as a stand-alone screen, as seen in FIG. 5. Alternatively, the display 110 can be incorporated into the sight array 30, as seen in FIGS. 6 and 7.

Referring again to FIGS. 4-5 and 7-8, controls 120 are provided as a user interface for triggering or activating the bow sight 20. The controls 120 include a trigger button 121 and multiple other buttons, dials, or other suitable user interface devices, that are adapted to navigate through menus shown on the display 110, and/or otherwise input information or data into the bow sight 20 or activate features of the bow sight 20. In other words, triggering or activating the bow sight 20 by way of controls 120 allows the processor 80 to start taking inputs directly from the archer or accepting and evaluating signals from the sensor system 40, whereby a predicted arrow flight path can be determined and a single aim indicator 35 can be illuminated based on such evaluation (s). Controls 120 may be configured to allow an archer to, e.g., change or modify the information selected for display by the control and display system 100, and/or control other functions of the bow sight 20. The controls 120 may comprise one or more of buttons, arrows, or dials. A trigger is currently preferred.

5. Bow Sight Use

Figure 12:
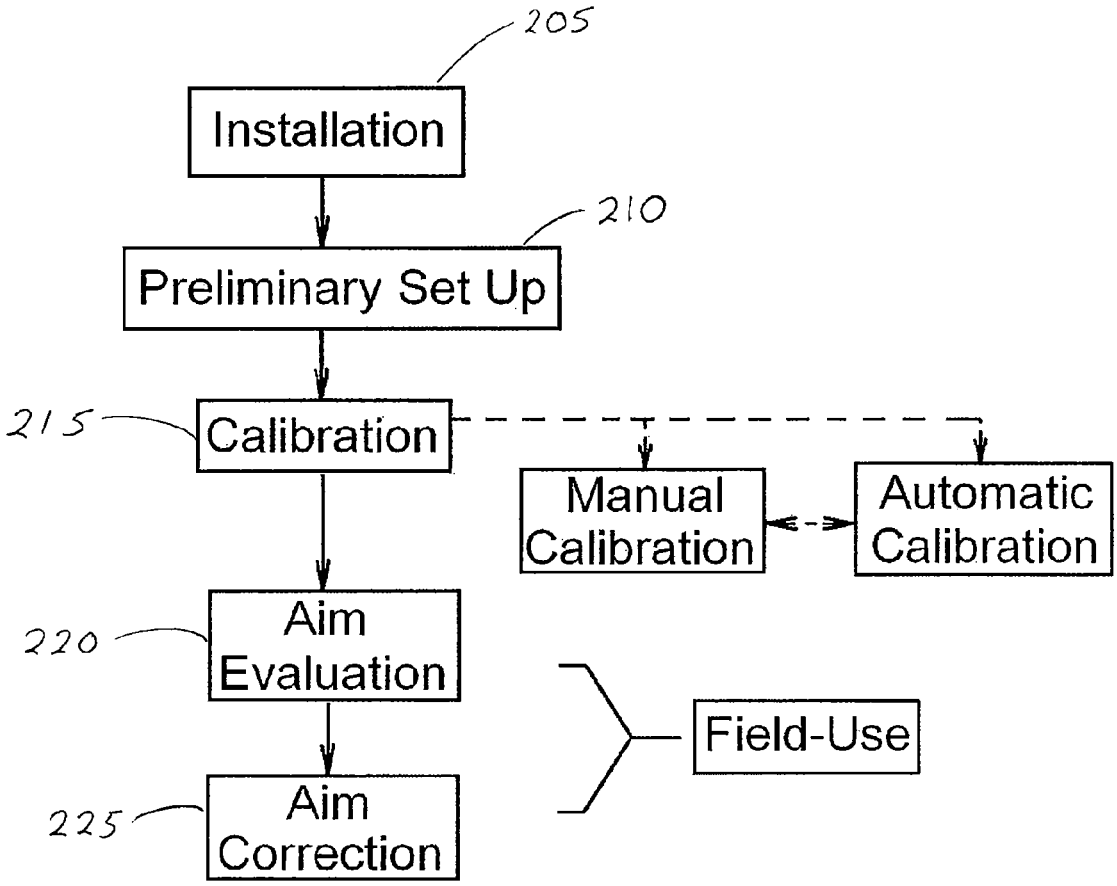
FIG. 12 is a flowchart showing use steps of the bow of FIG. 1.

Referring now to FIG. 12, bow sight 20 is preferably used in the following way. During an installation block 205, the bow sight 20 is physically installed on bow 5, preferably as a single unitary assembly. Once installed, a preliminary set up block 210 is performed to suitably align the bow sight 20 or its various components, e.g., the aim indicators 35 with an arrow rest, handle 10, riser 8, or other portions of the bow 5. Next, a calibration block 215 is performed to manually and/or automatically instruct the bow sight 20 as to how much correction or compensation is needed, in light of different arrow flight influencing factors, for the particular bow 5 upon which the bow sight 20 is installed. Once calibrated, the bow sight 20 is ready for field-use in which the bow sight 20, as initiated by the archer, performs a situation-specific aim evaluation block 220 and a situation specific aim correction block 225 based on such evaluation block 220. During the aim correction block 225, an aim indictor 35 is illuminated or otherwise displayed at a calculated or otherwise determined aiming position that compensates or corrects for the particular factors that were evaluated.

The steps of this using bow sight 20 will now be described in greater detail.

6. Installation and Preliminary Set Up

Referring now to FIGS. 2, 5, 7, and 12, bow sight 20 is preferably implemented and installed on bow 5 as a single unitary assembly with conventional hardware during the installation block 205. Once physically installed on the bow, during the preliminary set up block 210, the bow sight 20 is sighted in to a default sighted-in position with the line of site from the peep site through the bowsight crosshairs parallel to the arrow flight and the vertical crosshair in the plane of the bow string travel. The setup procedure or preliminary set up block 210 is used to physically position and align the targeting sight 31 upon the bow 5 so that a default sighting-in position may be established for the bow sight 20.

Establishing the default sighted-in position of the bow sight 20 is preferably done mechanically by, e.g., adjusting hardware of, and physically moving the sight array 30 components thereof, and/or other components of the bow sight 20, so that the targeting sight 31 is properly aligned with respect to the bow 5. Seen best in FIGS. 5 and 7, the hardware, such as, a bracket(s) that includes rails, tracks, or slides, connects the sight array 30 and base 25 to the bow 5, while allowing the sight array 30 to be movable with respect to the bow 5 and its arrow rest, as needed for sighting in bow sight 20. By using such hardware, the targeting sight 31 is positioned vertically, angularly, and horizontally with respect to the arrow and its arrow rest, bowstring 16, and peep sight 18. Namely, the targeting sight 31 is moved to and then fixed at a position in which the targeting sight 31 (or its crosshairs) lies within (i) a line of sight that extends linearly defined through the peep sight 18 and that is parallel to the arrow when the bow 5 is fully drawn, and (ii) a vertical plane that extends forward from the bowstring 16 and that longitudinally bisects the arrow.

Alternatively, the default sighted-in position of the bow sight 20 may be established by a combined hardware adjustment and software manipulation. This can be accomplished by combining at least parts of the above-described procedures for physically moving the sight array 30, and for using the controls 120 to manipulate software of the processor 80 to establish the default sighted-in position of aim indicator 35, both of which are discussed above and therefore are not repeated here. As with the above-discussed hardware-only default sighting-in procedure, the combined hardware and software procedure need not require the shooting of any arrows, but instead, may be a largely geometric-based alignment procedure for spatially positioning the crosshairs of the targeting sight 31 in a suitable location upon the particular bow 5.

7. Correction Calibration

Still referring to FIGS. 2, 5, 7, and 12, once the targeting sight 31 has been properly positioned to define the default sighted-in position of bow sight 20, the bow sight 20 can accurately display an aim indicator 35 once certain bow setup variables have been entered, in other words as based on the situation-specific shooting factors by implementing bow setup variables such as arrow weight, the fully drawn distance between the peep sight 18 and the crosshairs of the targeting sight 31, arrow release speed from the bow 5. Preferably, only arrow release speed or bow launch velocity, arrow weight, and/or the fully drawn distance between the peep sight 18 and the crosshairs of the targeting sight 31, are entered to allow the bow sight 20 to accurately display an aim indicator 35 based on a specific shooting situation. Various ones of such inputs can be initially programmed into the bow sight 20 manually or automatically and then further tuned, fine-tuned, and/or calibrated either manually or automatically, depending on the particular configuration of the bow sight 20. Stated another way, the bow sight 20 may be at least partially programmed or preprogrammed with assumed or average values for such bow-setup variables, which can be calibrated to adjust for, for example, actual aerodynamic arrow drag and/or other actual values of the particular setup or configuration of bow 5.

7a. Manual Calibration

Referring yet further to FIGS. 2, 5, 7, and 12, manual calibration may performed during the calibration block 215 without any previously determined ballistics information for the particular setup of bow 5. For typical implementations, the manual calibration uses tools, devices, and information that is readily available at typical archery shops or ranges. Information can be inputted into the bow sight 20, allowing the processor 80 to determine a best fitting one of multiple preloaded calibration setups that can be used as a starting point for the manual calibration. For example, an arrow speed measuring device is used to determine arrow launch speed which is entered into the bow sight 20. Preprogrammed calibrations can include, (i) a first calibration setup for bows having known arrow speeds of less than 200 feet per second, (ii) a second calibration setup for bows having known arrow speeds of between about 200 feet per second to about 250 feet per second, (iii) a third calibration setup for bows having known arrow speeds of between about 250 feet per second to about 300 feet per second, and (iv) a fourth calibration setup for bows having known arrow speeds of greater than about 300 feet per second.

Other information that can be used by the processor 80 in determining a suitable initial calibration setup can include arrow-specific setups, whereby the initial calibration procedure programs the processor 80 to consider, not only bow performance characteristics, but also arrow and arrow-related characteristics which can influence arrow flight. Such arrow-related characteristics include, but are not limited to, arrow manufacturer and model, arrow material composition, arrow length, arrow weight, and fletching size and type. Other arrow-related characteristics can include broadhead manufacturer and model, broadhead weight, number of blades, and/or others.

After the information has been entered into the bow sight 20 and the processor 80 selects and loads the most appropriate or best fitting initial calibration setup, then actual shooting performance is evaluated and adjustments to the calibration setup are made until automatic aiming corrections are being suitably achieved via corrected data and calculations internal to the unit. To do this, bow 5 is shot at long range, preferably at a target that is approximately 50 yards out, and uses the controls 120 to select a tuning or calibration adjustment mode for the bow site 20.

Referring still to FIGS. 2, 5, and 7, and referring generally to a manual calibration procedure, after putting the bow site 20 into the tuning or calibration adjustment mode, the archer can manually calibrate or tune the correction calibration of the bow site 20 via a simple trial and error session setting at a shot range. The archer would simply hit the trigger or manipulate other components of the controls 120 as many times as is required to adjust the height or lateral position of the aim indicator 35 to compensate for realized targeted shot error due to the situation-specific shooting and environmental factors that influence arrow flight at that moment, such as shooting elevation or bow inclination or wind speed and direction. Regardless, there are no typical screws or yardage pins to adjust. Instead, all the adjustments can be made electronically with the touch of the trigger button 121 or other input device of controls 120.

Referring now more specifically to the manual calibration procedure, the archer aligns the crown 32 of the targeting sight 31 with the top edge of the peep sight opening, centers the crosshairs of the targeting sight 31 within the peep sight 18 and depresses the trigger 121 to evaluate the particular distance and shot angle to the target, as seen in FIG. 9. Then, based on the evaluated distance, shot angle and the initial calibration setup, the processor 80 determines or calculates an aiming position that compensates for the arrow drop that is expected at that particular shooting distance based on ballistics that are either known or estimated. The processor 80 commands the illumination or display of an aim indicator 35 at the particular calculated aiming position. The archer tilts the bow 5 upward, moving the targeting sight 31 out of the peep sight 18 and centering the aim indicator 35 within the peep sight 18, as seen in FIG. 10, aiming at the bulls-eye of the target, and shoots or releases the arrow.

This procedure preferably is repeated three or more times to establish a shot pattern. The archer evaluates where the shot pattern is located versus where the archer aimed and adjusts the bow sight 20 as needed. This adjustment calibrates the bow sight 20 accordingly. For example, if the shot pattern is grouped below the bulls-eye, then the archer can adjust the sight so that a lower aim indicator 35 will be displayed at that same distance which will raise the arrow position upon the target. This result is likely due to inputs that underestimate the aerodynamic drag of the arrow. By making the correction this drag factor will be appropriately increased for all shot circumstances in the future such as new distances, angles and wind speeds and direction. In some embodiments, such adjustment is performed by pressing and holding one of the buttons of the input 120 for a predetermined amount of time, for example, 3 seconds. This is repeated until the archer is satisfied with the distance compensation or correction being performed by the bow sight 20, by making incremental, one LED dot at a time, adjustments that can move the shot grouping about 2 or 3 inches per adjustment at 50 yards, with each of the changes that is made to the calibration being saved in the memory of the bow sight 20.

Referring specifically now to FIG. 6-8 and the tunability or adjustability of LCD or other see through display incorporating sight arrays 30, at a shooting distance of 50 yards and with a 30-inch distance between the peep sight 18 and the targeting sight 31, a resolution of 0.6 inch at the target is achieved. This allows movement of the aim indicator 35 on the LCD screen by 0.010" (0.25 mm) increments both horizontally and vertically, which makes adjustments on the target point 50 yards away that are in increments of 0.6" on each axis.

The manual calibration or calibration-correcting procedures, are equally applicable to the lateral or windage corrections. Accordingly, the same general procedure may be followed to manually adjust the amount of correction that was calculated to compensate for the windage factors The bow sight 20 is placed in tuning or calibration adjustment mode, and the archer shoots and evaluates the shot pattern while enduring a side wind. If the shot pattern is not suitably close to the intended impact area of the target, then correction is done incrementally, one LED at a time, until the amount of transverse or windage compensation performed by the bow sight 20 is found acceptable.

7b. Automatic Calibration

Referring still to FIGS. 2, 5, and 7, the calibration block 215 may be performed automatically by using previously-determined ballistics information for the particular setup of the bow and the arrows being used. Here again, the memory device of the bow sight 20 preferably has multiple preloaded calibration setups that correspond to known performance characteristics of various bow manufacturers and models. A user activates one of multiple stored calibration setups by entering a code, through controls 120, that corresponds to the particular bow being used. Optionally, the multiple stored calibration setups are stored on external media, for example, on a CD or other electronic media device. In yet other embodiments, the calibration setups are stored remotely and are accessible, for example, through the Internet or by way of some other electronic network that allows users to download bow-specific calibration setups, optionally, updated bow-specific calibration setups.

As one example of a suitable automatic calibration procedure, an archer can log into the bow sight vendor's website and request ballistic information for his Acme Model 1240 bow and his Delta Model 810 arrows. In this example, the archer may download information indicating that a Model 810 Delta arrow will travel at an initial velocity of 200 feet per second and drop 110 inches over a 50-yard flight path when shot horizontally from the fully-drawn Acme Model 1240 bow. Once the requested ballistic information is obtained, it can be downloaded into the memory device that cooperates with processor 80 using, e.g., a USB cable that plugs into a port 81 (FIGS. 4 and 7), a wireless transmitter, or other suitable hardware. Once the correction calibration is done, the archer may, if desired, test the calibration and/or adjust the calibration by way of the above-discussed manual calibration procedures, and then use the bow sight 20 to perform situation-specific aim evaluations and corrections although little if any are required.

8. Initiating Situation-Specific Evaluation

Referring still to FIGS. 2, 5, 7, and 12, the archer initiates the situation-specific aim evaluation block 220 in which one or more of the sensors of sensor system 40 determines a corresponding value at that instant or for that specific situation and transmits such value (or a signal corresponding thereto) to the processor 80. Stated another way, during the evaluation block 220, the sensor system 40 surveys or evaluates various situation-specific shooting and environmental factors that may influence arrow flight, and communicates its findings to the processor 80. The evaluation can be initiated by, for example, pulling the trigger button 121 or depressing another button of controls 120. Doing so activates at least one of the shooting and environmental factor-detecting components of sensor system 40. In other words, one or more of the range finder 50, inclinometer 60, and anemometer 70 detects a value for respective ones of target distance, bow angle, and wind speed and direction, and transmits such values to the processor 80. The processor 80 then displays or illuminates a specific aim indicator 35 at a calculated precise aiming position that compensates or corrects for such values detected by the sensor system 40.

Such information or values detected by the sensor system 40 are compared with the corresponding default sighted-in values. For example, processor 80 compares actual or situation-specific shooting distance values, determined by range finder 50, to the previously established default sighted-in distance. The actual or situation-specific bow angle values that are determined by inclinometer 60 are compared to the default sighted-in bow angle. The actual or situation-specific wind speed and direction values that are determined by anemometer 70 are compared to the default sighted-in wind speed and direction values.

Referring now to FIGS. 5, 7, 9-10, and 12, during a typical field use of the bow sight 20, when the archer sees a game animal, the archer nocks an arrow and fully draws the bow 5. The archer then centers the targeting sight 31 in the peep sight 18 (FIG. 9) and pulls and releases the trigger button 121 which activates the range finder 50 and displays the shooting distance to the animal on the display 110. At the same time, if the bow sight 20 includes an inclinometer and/or anemometer, then the shooting angle and wind direction and speed are also evaluated at the same time and corresponding signals are sent to the processor 80.

9. Situation-Specific Aim Correction

Referring again to FIGS. 2, 5, 7, and 12, after the processor 80 receives such signals, the processor 80 determines the extent that the actual or situation-specific distance, bow angle, and wind speed and direction values deviate or differ from the corresponding default sighted-in values. During a situation specific aim correction block 225, the processor 80 uses an algorithm or other programming to evaluate such values in light of the particular calibration that is stored in the memory of the bow sight 20, so as to calculate a precise aiming position that is required to compensate or correct for such deviations. The processor 80 then illuminates or displays an aim indicator(s) 35 that is closest to the calculated precise aiming position, allowing the archer to take dead aim at the animal by tilting the bow 5 until the aim indicator 35 is centered in the peep sight 18 (FIG. 10) and aligned upon the desired arrow strike location on the animal.

The following example describes, in detail, one suitable manner in which the processor 80 determines how much compensation or correction is required in a vertical direction and thus which aim indicator(s) 35 should be illuminated or otherwise displayed. In the embodiment in which arrow ballistic information is programmed or stored in the memory of the bow sight 20, the processor may mathematically calculate an angle of compensation that is required for taking dead aim at a particular target by using the values determined during the preceding evaluation block 220. Namely, the processor 80 considers values for a shooting distance (D) to the target as provided by the range finder 50, and an angle (theta) of the arrow in the drawn bow 5 with respect to the horizontal as provided by the inclinometer 60.

From such information, the processor 80 calculates a horizontal travel distance of the arrow by the formula D×cosine (theta). The processor 80 calculates an arrow flight time based on the horizontal travel distance of the arrow in light of the known arrow ballistics information such as one or more of, e.g., arrow exit speed from the bow, arrow weight, and arrow aerodynamic drag of the arrow. The processor 80 then uses the arrow flight time to calculate an amount of predicted arrow drop and/or corresponding angle of compensation required, as a function of the arrow flight time and the acceleration of gravity. The processor 80 illuminates or otherwise displays a particular aim indicator 35 to force the archer to tilt the bow by the angle of compensation that was calculated to assure an accurate shot is made.

Regardless of the particular way in which the processor 80 determines which aim indicator to illuminate or otherwise display, the aim indicator 35 stays illuminated or displayed for a predetermined amount of time, for example, 30 seconds or 1 minute, after the situation-specific aim evaluation and correction and the situation-specific aim evaluation and correction procedure starts over each time the archer commands such an evaluation and correction, for example, each time the archer pulls or depresses the trigger button 121 or another button of controls 120. This feature allows an archer to repeat the process if the animal moves or if, e.g., the wind conditions change while the bow 5 is drawn, so as to update the evaluation and, if needed, illuminate or display a different aim indicator 35 based on the exact conditions at that particular time.

Many changes and modifications may be made to the present invention without departing from the spirit thereof. The scope of some of these changes is discussed above. The scope of others will become apparent from the appended claims.

We claim:

1. An auto-correcting bow sight, comprising:

a range finder supported on a bow incorporating the auto-correcting bow sight, the range finder determining a range to a target;

an inclinometer supported on the bow and determining an angle of inclination of the bow;

a processor supported on the bow and receiving information from the range finder and the inclinometer relating to the range to target and the angle of inclination of the bow, respectively;

multiple aim indicators being operably connected to the processor, wherein the processor controls which of the multiple aim indicators is displayed at a given time based on at least one of (i) the range to target, and (ii) the angle of inclination of the bow, information; and a manually actuated input device that is operably connected to the processor and that can be actuated for beginning an evaluation by the processor that determines which of the multiple aim indicators to display based on the at least one of the range to target and the angle of inclination of the bow, and wherein the manually actuated input device is arranged upon the bow to allow actuation of the input device by an archer when the bow is in a fully drawn position.

2. The auto-correcting bow sight of claim 1, wherein some of the aim indicators are vertically aligned with each other.

3. The auto-correcting bow sight of claim 2, wherein some other multiple aim indicators are horizontally aligned with each other.

4. The auto-correcting bow sight of claim 1, the multiple aim indicators comprising at least one of (i) light emitting diodes, and (ii) portions of fiber optic strands conveying light from a bank of diodes mounted remotely with respect to the multiple aim indicators.

5. The auto-correcting bow sight of claim 1, wherein the input device comprises a triggering button, and wherein a peep sight is mounted to a bow string of the bow and a targeting sight is positioned with respect to the peep sight and the range finder so that a user can align the targeting sight and target as viewed through the peep sight while actuating the triggering button to begin the evaluation.

6. The auto-correcting bow sight of claim 1, wherein the processor controls which of the multiple aim indicators is displayed based on at least one of, arrow weight, arrow initial release speed from the bow, arrow aerodynamic drag characteristics, and broadhead weight.

7. The auto-correcting bow sight of claim 1, wherein at least one of the multiple aim indicators are selectively displayed in a see-through panel display.

8. The auto-correcting bow sight of claim 7, wherein ones of the multiple aim indicators, a value indicative of a shooting angle of the bow, and a value of a distance to target that corresponds to the range to target is displayed on the see-through panel display.

9. The auto-correcting bow sight of claim 1, wherein the multiple aim indicators define discrete dots.

10. The auto-correcting bow sight of claim 1, further comprising an anemometer operably connected to the processor and determining values of at least one of wind speed and direction, the anemometer sending a signal that corresponds to the determined values to the processor, and wherein the processor controls which of the multiple aim indicators is displayed at a given time based on (i) the distance to target, (ii) the angle of inclination of the bow, and (iii) at least one of wind speed and direction.

11. The auto-correcting bow sight of claim 10, wherein the aim indicator that is displayed compensates for at least one of the (i) the distance to target, (ii) the angle of inclination of the bow, and (iii) at least one of wind speed and direction, and wherein the aim indicator that is displayed is directly alignable with an intended strike area of the target while shooting an arrow from the bow.

12. The auto-correcting bow sight of claim 1, wherein the processor can determine a precise aiming position based on both of (i) the range to target, and (ii) the angle of inclination of the bow and can display at least one of the multiple aim indicators at the precise aiming position in a manner that allows an archer to take dead aim at the target.

13. A method of displaying an aim indicator in a bow sight to compensate for situation-specific shooting factors, the method comprising:

evaluating a shooting distance defined between a bow and a target;

evaluating a vertical shooting angle of the bow; and determining a precise aiming position based on the shooting distance and the vertical shooting angle of the bow;

displaying an aim indicator at the determined precise aiming position so as to compensate for the vertical shooting angle of the bow in a manner that allows an archer to take dead aim at the target with the aim indicator that is displayed at the precise aiming position; and fully drawing the bow and, while the bow is in a fully drawn position, manually actuating an input device that initiates at least one of the steps of evaluating the shooting distance, evaluating the vertical shooting angle, and determining the precise aiming position.

14. The method of claim 13, further comprising shooting an arrow from the bow at a known range and performing a correction calibration step.

15. The method of claim 14, wherein the known range is determined by a range finder.

16. The method of claim 13, further comprising performing a correction calibration step by instructing a processor within the bow sight as to how much aim compensation is required based on known performance characteristics of the bow.

17. The method of claim 16, further comprising performing a correction calibration step by instructing the processor as to how much aim compensation is required based on known characteristics of an arrow being used with the bow.

18. The method of claim 17, further comprising electronically transferring information to the bow sight for instructing the processor as to how much aim compensation is required based on known performance characteristics of an arrow that is being used with the bow.

19. The method of claim 17, further comprising activating one of multiple calibrations setups that are stored in a memory device of the bow sight.

20. The method of claim 13, wherein the input device comprises a triggering button, and wherein actuating the triggering button a first time begins a first determining of a precise aiming position and displaying of a first aim indicator at the first precise aiming position while the bow is fully drawn and wherein the method further comprises actuating the triggering button a second time and beginning a second determining of a second precise aiming position and displaying of a second aim indicator at the second precise aiming position while the bow remains fully drawn so as to correct for situation-specific changes in a shooting situation while the bow remains fully drawn.

21. The method of claim 13, further comprising viewing a targeting sight through a peep sight that is mounted in a string of the bow and aligning the target with the targeting sight and peep sight while the bow is in the fully drawn position during the initiation of the at least one of the evaluating the shooting distance, the evaluating the vertical shooting angle, and the determining the precise aiming position steps.

22. The method of claim 21, wherein the targeting sight is integrated into the auto-correcting bow sight and fixed with respect to the bow and the peep sight when the bow is fully drawn so that during multiple initiations of the at least one of the evaluating the shooting distance, the evaluating the vertical shooting angle, and the determining the precise aiming position steps, the targeting sight, the bow, and the peep sight are in constant relative positions with respect to each other.

23. An auto-correcting bow sight, comprising:

a sensor system that is mounted to a bow and that is configured to determine both of a range to a target and an angle of inclination of the bow; and multiple aim indicators that are mounted on the bow and are operably connected to the sensor system so that the ones of the multiple aim indicators can be selectively displayed based at least in part on both of the range to target and the angle of inclination of the bow; and a manually actuated input device that is operably connected to the sensor system and that is configured so that actuating the input device can initiate an evaluation of which ones of the multiple aim indicators can be selectively displayed based at least in part on both of the range to target and the angle of inclination of the bow, wherein the input device is configured to allow actuation of the input device by an archer when the bow is in a fully drawn position so as to permit the initiation of the evaluation while the bow is in the fully drawn position.

24. The auto-correcting bow sight of claim 23, wherein the sensor system comprises a range finder and an inclinometer that are both integrated into the auto-correcting bow sight.

25. The auto-correcting bow sight of claim 24, further comprising a base that is attached to the bow for supporting the auto-correcting bow sight such that each of the range finder and the inclinometer are supported on the bow by way of the base of the auto-correcting bow sight.

26. The auto-correcting bow sight of claim 25, wherein the input device comprises a triggering button that is supported by the bow at a location that is spaced from the base of the auto-correcting bow sight so as to allow actuation of the triggering button by an archer when the bow is in a fully drawn position.

* * * * *